US006266937B1

(12) United States Patent
Watanabe

(10) Patent No.: US 6,266,937 B1
(45) Date of Patent: Jul. 31, 2001

(54) FASTENING MEMBER FOR VERTICAL BOARD SIDING, METHOD OF FASTENING LOWER END OF SIDING BOARD USING THE FASTENING MEMBER, AND STRUCTURE FASTENED USING THE FASTENING MEMBER

(75) Inventor: Morimichi Watanabe, Aichi (JP)

(73) Assignee: Nichiha Corp., Aichi (JP)

( * ) Notice: Subject to any disclaimer, the term of this patent is extended or adjusted under 35 U.S.C. 154(b) by 0 days.

(21) Appl. No.: 09/362,565

(22) Filed: Jul. 28, 1999

(30) Foreign Application Priority Data

Sep. 28, 1998 (JP) ..... 10-273265

(51) Int. Cl.[7] ..... E04B 2/30

(52) U.S. Cl. ..... 52/489.2; 52/506.05; 52/512; 52/544; 52/713; 52/715; 52/748.11; 24/292

(58) Field of Search ..... 24/292, 293, 295; 52/285.3, 344, 357, 489.1, 489.2, 506.05, 512, 544, 547, 549, 712, 713, 715, 748.11, 508, 509, 513

(56) References Cited

U.S. PATENT DOCUMENTS 3,103,265 * 9/1963 Meyer ..... 24/295 X
3,350,830 * 11/1967 Smith, Jr. et al. ..... 52/489.1 X
4,010,589 * 3/1977 Gross ..... 52/489.1
4,263,764 * 4/1981 Wendt ..... 52/713 X
4,268,091 * 5/1981 Marshall, Jr. ..... 24/295 X
4,467,579 * 8/1984 Weinar ..... 52/489.2 X
4,765,111 * 8/1988 Osawa ..... 52/509

* cited by examiner

*Primary Examiner*—Carl D. Friedman
*Assistant Examiner*—Kevin D. Wilkens
(74) *Attorney, Agent, or Firm*—Lowe Hauptman Gilman & Berner, LLP

(57) ABSTRACT

A fastening member for the vertical board siding, which comprises; a main metal fitting comprising a flat substrate, first and second upright portions formed at the upper and lower end portions of the flat substrate, respectively and extending in the horizontal direction, a third upright portion formed along the longitudinal direction of the flat substrate, and an engaging portion formed at a distal end of the third upright portion; and an auxiliary metal fitting adapted to be detachably engaged with the main metal fitting and comprises a first horizontal portion adapted to be placed on the second upright portion of the main metal fitting, and a second horizontal portion adapted to support a lower end portion of the siding board to be fastened.

17 Claims, 12 Drawing Sheets

FASTENING MEMBER FOR VERTICAL BOARD SIDING, METHOD OF FASTENING LOWER END OF SIDING BOARD USING THE FASTENING MEMBER, AND STRUCTURE FASTENED USING THE FASTENING MEMBER

BACKGROUND OF THE INVENTION

This invention relates to a fastening member to be employed for a vertical board siding using for instance a ceramic siding board, in which the ceramic siding boards are attached to a building frame with the longitudinal direction of each ceramic siding board being orientated in the vertical direction. This invention also relates to a method of fastening the lower end portion of siding board in the vertical board siding using the fastening member, and to a board siding constructed using the fastening member.

The board siding using a ceramic siding board has been executed either by a horizontal board siding where the siding board is attached to the framework of building with the longitudinal direction of the ceramic siding board being directed in the lateral direction (horizontal direction), or by a vertical board siding where the siding board is attached to the framework of building with the longitudinal direction of the ceramic siding board being directed in the upright direction (vertical direction).

According to the horizontal board siding, as shown in FIG. 11, a moisture permeable waterproofing sheet (or an asphalt saturated felt) 3 is attached at first to a framework consisting of posts 1 and studs 2, and then, in conformity with the longitudinal directions of the posts 1 and studs 2, vertical furring strips 4 are attached to the posts 1 and studs 2 with the moisture permeable waterproofing sheet 3 being interposed therebetween. Thereafter, external wall panels (siding boards) (not shown) are fastened to the vertical furring strips 4, thereby forming a ventilation layer between the moisture permeable waterproofing sheet 3 and the siding boards.

The jointing in vertical direction of the siding boards has been performed either by a method wherein the rabbeted edge portion of a siding board is directly fitted in or engaged with the rabbeted edge portion of another siding board, and then the siding boards are nailed and fixed to the vertical furring strips 4, or by a method wherein instead of the aforementioned engagement between the rabbeted edges of siding boards, a shiplap joint portion of the siding board is fully engaged with a dedicated fastening member, which is then fixed to the vertical furring strips 4 by making use of a nail (or a screw). Since the horizontal board siding employing the aforementioned fastening member is advantageous not only in fastening strength and durability but also in simplicity of executing method, the horizontal board siding is now increasingly employed.

On the other hand, according to the vertical board siding, as shown in FIG. 12, a moisture permeable waterproofing sheet (or an asphalt saturated felt) 3 is attached at first to a framework consisting of posts 1 and studs 2, and then, horizontal furring strips 5 extending across the posts 1 and studs 2 are horizontally attached to the posts 1 and studs 2 with the moisture permeable waterproofing sheet 3 being interposed therebetween, thereby fastening several lines of horizontal furring strips 5 which are spaced apart in vertical direction from each other by a predetermined distance. Thereafter, external wall panels (siding boards) (not shown) are fastened to the horizontal furring strips 5. In this case, a space "s" is provided between the horizontally neighboring horizontal furring strips 5, thereby securing a ventilation passage.

As seen from FIG. 13 showing the horizontal cross-sectional view of a fastening state in this board siding and from FIG. 14 showing the front wall surface of the resultant siding structure, the horizontal jointing between the neighboring siding boards 10 is effected by the engagement between the rabbeted edge portions of the siding boards 10, while the vertical jointing between the vertically neighboring siding boards 10 is effected by making use of a draining metal fitting 6. Further, the fastening of the siding boards has been conventionally performed by means of nailing work using a nail or a screw 11.

Furthermore, in the execution of the board siding at the upper side region of the opening portion "W" such as a window, since the siding boards are not required to be attached to the portion below the upper side of the opening portion "W" as shown in FIG. 12, it is impossible to employ such a fastening means as the draining metal fitting 6 shown in FIG. 14. Therefore, there has been conventionally adopted a fastening method where the lower end portion of the siding board 10 is fixed to a horizontal furring strip 5*a* by means of nailing as shown in FIG. 15. In FIG. 15, "WS" denotes a window frame (sash).

As described above, according to the vertical board siding, the horizontal jointing between the neighboring siding boards is effected by the engagement between the rabbeted edge portions of the siding boards, the vertical jointing between the vertically neighboring siding boards is effected by making use of a draining metal fitting, and the fastening of the siding boards is performed by means of nailing work. Therefore, in spite of the advantage that a joint sealing work which is required in the horizontal board siding is no more required in the case of the vertical board siding, a large number of relatively short horizontal furring strips are required to be fastened as a backing framework as shown in FIG. 12, so that it necessitates a longer working time as well as an increased material cost, thus giving a great influence to the working cost as well as to the construction period thereof. Further, the position of the external wall surface of building is caused to protrude externally by a distance corresponding to the thickness of the furring strip 5.

Additionally, since the nailing in this case is performed in such a manner that each siding board 10 is individually fixed to the furring strips using a nail 11, the jointing between the horizontally neighboring siding boards is not necessarily sufficient enough. In particular, since the siding boards are vertically fastened, the wind pressure resistive force of the siding boards thus fastened may not be sufficient, if the board siding has not been executed properly according to the prescribed specification for the board siding. Moreover, since the remedy for the head portion of the nail 11 is required after the board siding, the nailing is problematic in terms of aesthetic feeling.

Furthermore, when the siding board is to be fastened to the upper side of an opening such as a window, or to a wall portion where a roof is continuously extended from the lower end portion of the external wall, the siding board is required to be cut to a predetermined length before it is fastened or fixed to such a place. However, as mentioned above, since any siding board which can be utilized as an auxiliary fastening member is not existed below such a place, the fastening of a siding board to such a place is required to be performed by means of nailing while holding the siding board by one's hand.

BRIEF SUMMARY OF THE INVENTION

The object of this invention is to solve the aforementioned problems accompanied with the conventional vertical board siding. In particular, an object of the present invention is to provide a fastening member to be employed for the vertical board siding to be effected to a building frame, which enables the board siding to be performed easily and within a shortened period of time, which enables the fastening of the siding boards to be performed with a sufficient strength so as to withstand any wind pressure, and which enables the fastening of the lower end portion of the siding board to be easily and reliably performed even on the occasion of cutting the siding board to a predetermined length for the purpose of fitting it to the dimension of the wall portion to which the siding board is to be fastened without necessitating the conventional practice of nailing the siding board while holding the siding board by one's hand.

Another object of the present invention is to provide a method of fastening the lower end portion of siding board in the vertical board siding using the aforementioned fastening member.

Still another object of the present invention is to provide a structure constructed using the aforementioned fastening member.

With a view to realize the aforementioned objects, this invention provides a fastening member for the vertical board siding, which comprises;

a main metal fitting comprising a flat substrate constituting a mounting surface to a building frame, a first upright portion formed at an upper end portion of said flat substrate and extending in the horizontal direction, a second upright portion formed at a lower end portion of said flat substrate and extending in the horizontal direction, a third upright portion formed along a longitudinal direction of said flat substrate, and an engaging portion formed at a distal end of said third upright portion; and an auxiliary metal fitting which is adapted to be detachably engaged with said main metal fitting and comprises a first horizontal portion which is adapted to be placed on said second upright portion of said main metal fitting, and a second horizontal portion which is adapted to support a lower end portion of said siding board to be fastened.

According to a preferable embodiment of this invention, the second horizontal portion of the auxiliary metal fitting is configured so as to be placed on only one side of said third upright portion of the main metal fitting as the auxiliary metal fitting is mounted on the main metal fitting so as to prevent neighboring siding boards from interfering with each other and to facilitate the fastening of the siding boards.

The fastening member for the vertical board siding according to this invention is adapted to be employed in two different manner, i.e. a method of employment where only the main metal fitting is singly employed, and a method of employment where the auxiliary metal fitting is mounted on the main metal fitting. Namely, it is possible, with the employment singly of this main metal fitting, to reliably and vertically fasten the siding board to the stud (or post) with both sides of the vertically fastened siding board being held firmly. It is also possible, with the employment of the auxiliary metal fitting mounted on the main metal fitting, to reliably receive an lower end portion of the siding board and to reliably fasten the siding board to the stud. Therefore, even if the siding board is to be fastened to the stud after cutting the siding board to a predetermined length, it is possible to easily and reliably fasten the lower end portion of the siding board without necessitating the nailing of the siding board while holding the siding board by one's hand.

The fastening of the siding board to the stud by making use of the main metal fitting can be performed as follows. Namely, a plurality of main metal fittings are attached to one of the studs along the longitudinal direction of the stud, and then the siding boards are vertically placed on the main metal fittings with one side of each siding board being contacted with the third upright portion of the main metal fitting that has been fixed to the stud. Thereafter, a plurality of main metal fittings are fixed onto the neighboring stud along the longitudinal direction of the stud with the third upright portion thereof being contacted with the other side of each siding board. Since the siding board is fastened with the back surface thereof being placed on the first and second upright portions of the main metal fitting, a ventilation passage having a height corresponding to the height of the first and second upright portions can be secured between the surfaces of the studs and the back surfaces of the siding boards.

Therefore, it is no more required to attach a plurality of the horizontal furring strips across the studs as required in the conventional vertical board siding (the same in the case of two-by-four construction), and the nailing work can be also omitted. As a result, the fastening work can be greatly simplified, resulting in a prominent shortening of construction period and in a decrease in construction cost. Furthermore, since the remedy for the head portion of the nail is no more required, the aesthetic feeling of the resultant structure can be enhanced. Moreover, since the siding board is fastened in such a way that the vertical sides of siding board are clamped at a plurality of locations, the wind pressure resistive strength can be prominently enhanced as compared with the case where the siding board is fastened by means of nailing work.

Additionally, since the ventilation passage between the building frame and the siding boards is secured by the height of the first and second upright portions formed on the main metal fitting as mentioned above, and since these upright portions are provided simply for the purpose of securing the ventilation passage, the height of these upright portions is simply required to be the minimum required. As a result, it is now possible to decrease the interval between the back surface of the siding board and the building frame as compared with the conventional board siding using horizontal furring strips where the ventilation passage is secured by providing a space between the neighboring horizontal furring strips.

This invention also provides a method of using the main metal fitting together with an auxiliary metal fitting which is to be mounted on the main metal fitting. Namely, this invention provides a method of fastening a lower end portion of siding board in the vertical board siding by making use of a plurality of studs erected neighboring to each other, the method comprising the steps of; attaching the main metal fitting mounted thereon with the auxiliary metal fitting to the location of the stud where the lower end portion of the siding board is to be fastened; and fastening the siding board to the main metal fitting while rendering the lower end portion of the siding board to be received by the second horizontal portion of the auxiliary metal fitting.

This invention also provides a fastened structure of a lower end portion of a vertical type siding board, which is characterized in that the siding board is vertically fastened across a plurality of studs erected neighboring to each other, and that the lower end portion of the siding board is fastened to the main metal fitting mounted thereon with an auxiliary metal fitting while rendering the lower end portion of the siding board to be received by the second horizontal portion of the auxiliary metal fitting.

The "post" set forth in this specification includes all kinds of post extending vertically in the framework of the building frame such as a column, a stud, a stand pipe, a backing member in the two-by-four construction, etc.

DETAILED DESCRIPTION OF THE INVENTION

Figure 1A:
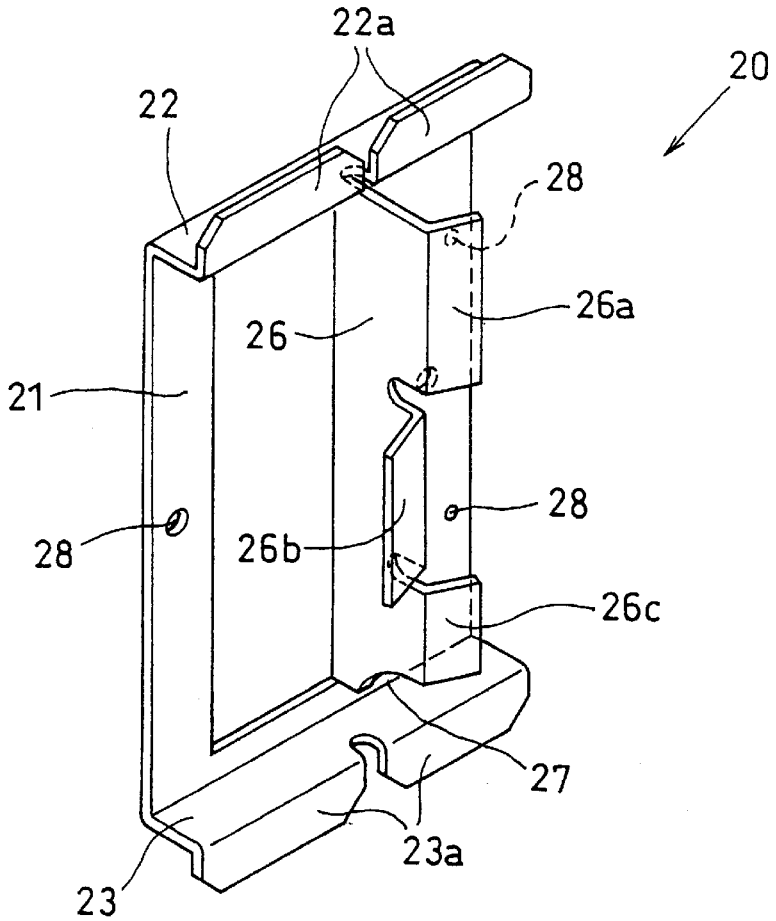
FIGS. 1*a* and 1*b* is a perspective view of a fastening member (a main metal fitting and an auxiliary metal fitting) for vertical board siding representing one embodiment of this invention.
Figure 1B:
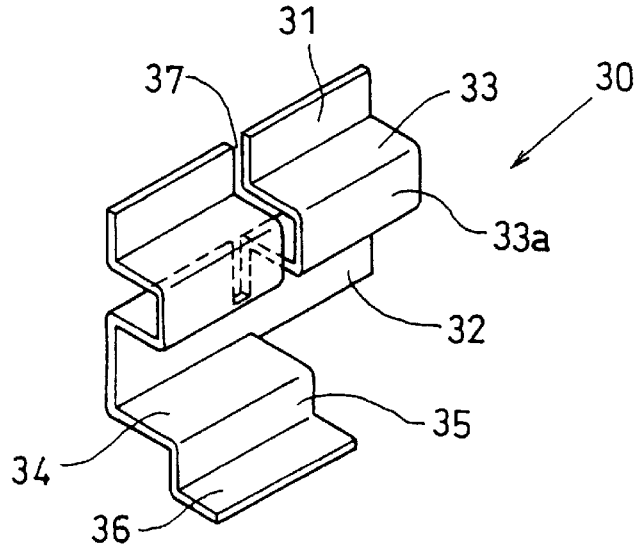

Preferable embodiments of this invention will be explained in details below with reference to the drawings. FIGS. 1*a* and 1*b* is a perspective view of a fastening member for vertical board siding representing one embodiment of this invention, wherein FIG. 1(*a*) illustrates a main metal fitting and FIG. 1(*b*) illustrates an auxiliary metal fitting.

In this embodiment, the main metal fitting 20 is manufactured by subjecting a stainless steel to punching and then to sheet metal working. Specifically, this main metal fitting 20 comprises a flat substrate 21 constituting a surface for attaching the main metal fitting 20 to a building frame, i.e. a framework including posts and studs, a first upright portion 22 which has been formed by bending the upper end portion of the substrate 21 by an angle of approximately 90° thereby rendering the bent portion to extend horizontally, the tip end portion of the first upright portion 22 being further bent upward by an angle of 90° thereby to form a vertical plane 22*a* which is parallel with the substrate 21, and a second upright portion 23 which has been formed by bending the lower end portion of the substrate 21 by an angle of approximately 90° thereby rendering the bent portion to extend horizontally, the tip end portion of the second upright portion 23 being further bent downward by an angle of 90° thereby to form a vertical plane 23*a* which is parallel with the substrate 21. The first upright portion set forth in this specification is constituted by this first upright portion 22 and the vertical plane 22*a,* while the second upright portion set forth in this specification is constituted by this second upright portion 23 and the vertical plane 23*a*.

Figure 7:
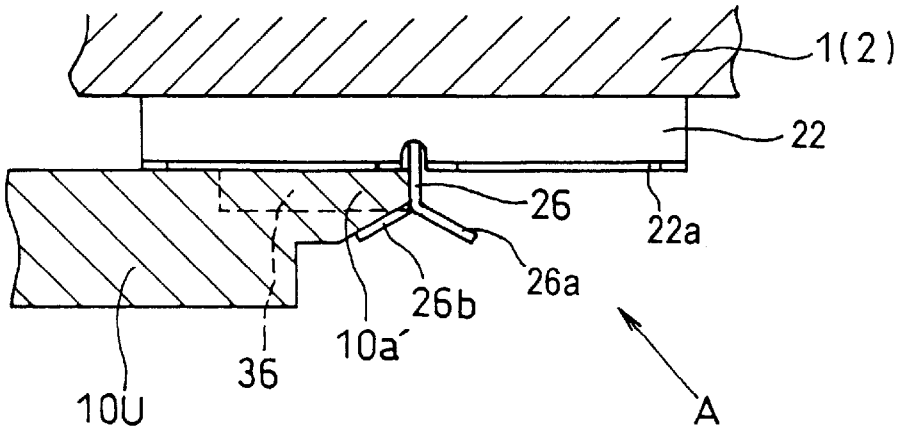
FIG. 7 is a top plan view illustrating a state wherein a cut siding board is fastened by making use of a fastening member shown in FIGS. 1*a* and 1*b;*

A portion of the substrate 21 which is located between the first upright portion 22 and the second upright portion 23 is cut and bent perpendicular to the surface of the substrate 21, thereby forming a third upright portion 26. The height "H" of this third upright portion 26 is set higher than the height "h" of both first and second upright portions 22 and 23, the difference between them (H-h) corresponding to the thickness of the tip ends of the rabbeted edge portion 10*a* of a siding board 10 to be fastened (see FIGS. 5 and 7).

Three locking strips 26*a,* 26*b* and 26*c,* each being bent in the opposite direction to each other alternately, are formed along the top end portion of this third upright portion 26. Further, one side edge portion of the third upright portion 26 which faces the second upright portion 23 is cut out to form a cutout portion 27. Furthermore, through-holes 28 are formed on both peripheral side portions of the substrate 21.

The auxiliary metal fitting 30 is manufactured by also subjecting a stainless steel to punching and then to sheet metal working, the lateral width of the auxiliary metal fitting 30 being slightly smaller as a whole than that of the main metal fitting 20. Specifically, this auxiliary metal fitting 30 comprises a first vertical plane 31 to be contacted with the substrate 21 of the main metal fitting 20, a second vertical plane 32 to be contacted with the substrate 21 of the main metal fitting 20, a U-shaped protruded portion 33 formed between the first vertical plane 31 and the second vertical plane 32 so as to link these planes 31 and 32 to each other, a first horizontal portion 34 extending forward at an angle of 90° from the lower edge portion of the second vertical plane 32, a third vertical plane 35 extending downward at an angle of 90° from the distal edge portion of the first horizontal portion 34, and a second horizontal portion 36 extending forward at an angle of 90° from the lower edge portion of the third vertical plane 35.

The upper surface 33*a* of the U-shaped protruded portion 33 is made flat, and the height of the upper surface 33*a* as the auxiliary metal fitting 30 is being mounted on the main metal fitting 20 is designed to become approximately the same as that of the vertical planes 22*a* and 23*a* formed respectively at the distal end of the upright portions 22 and 23 of the main metal fitting 20. Further, a slit 37 is formed in the auxiliary metal fitting so as to extend from the first vertical plane 31 via the U-shaped protruded portion 33 to the second vertical plane 32, the width of the slit 37 being set such that the third upright portion 26 formed on the main metal fitting 20 can be inserted therein.

The first horizontal portion 34 is formed extending along only part of the second vertical plane 32, which corresponds to only one side (the left side of the slit 37 in FIG. 1(*b*)) of the slit 37. The dimension of the forward extended distance of the first horizontal portion 34 is set such that the distal edge portion of the first horizontal portion 34 coincides with the distal edge portion of the second upright portion 23 of the main metal fitting 20 as the auxiliary metal fitting 30 is mounted on the main metal fitting 20. Although there is not any particular limitation with regard to the length of the third vertical plane 35, the length of the third vertical plane 35 should preferably be approximately the same as the vertical plane 23*a* which is formed on the distal end of the second upright portion 23 of the main metal fitting 20 as shown in FIG. 1(*b*). The dimension of the forward extended distance of the second horizontal portion 36 is preferably set such that the distal edge portion of the second horizontal portion 36 coincides approximately with the height of the third upright portion 26 formed on the main metal fitting 20.

Next, a specific manner of employing the fastening member for vertical board siding will be explained.

Figure 2A:
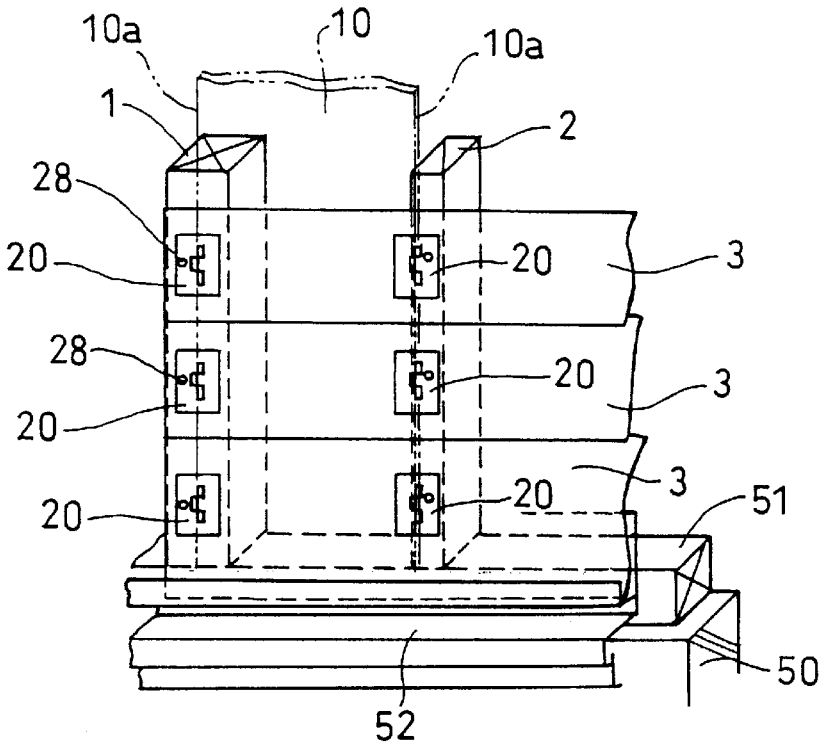
FIG. 2*a* is a perspective view illustrating the procedures of the vertical board siding by making use of the fastening member shown in FIGS. 1*a* and 1*b;*
Figure 2B:
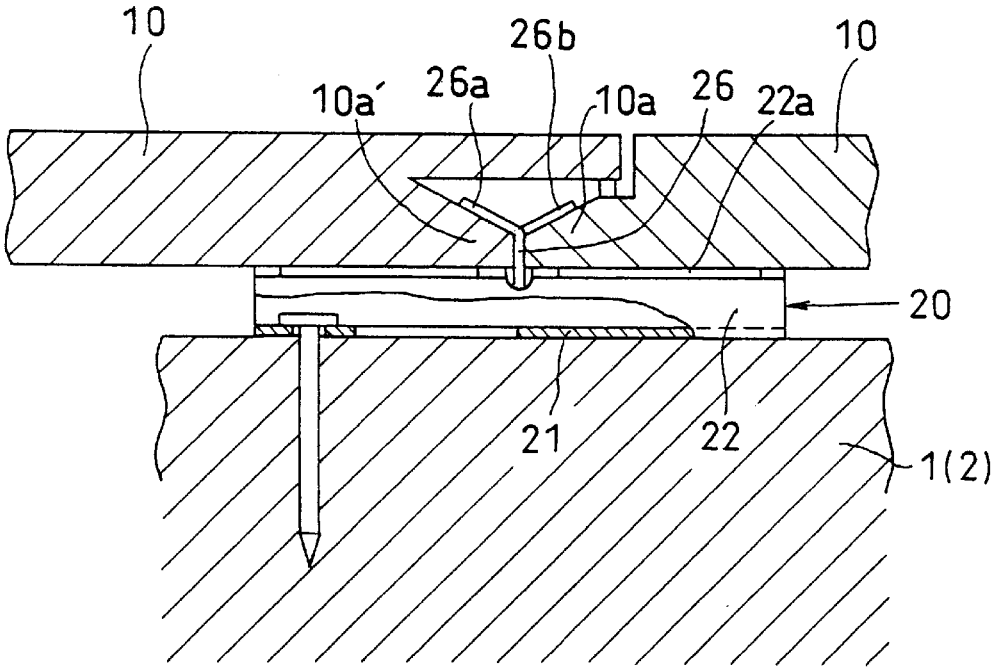
FIG. 2*b* is a partial sectional view illustrating a state after finishing the vertical board siding.

First of all, as shown in FIG. 2(*a*), a moisture permeable waterproofing sheet (or an asphalt saturated felt) 3 is attached at first to a building frame, i.e. the framework consisting of posts 1 and studs 2 in the same manner as the conventional board siding. In FIG. 2, the reference numeral 50 denotes a foundation, and 51 denotes a base mounted on the foundation 50. A draining metal fitting 52 is fastened along the base 51. This manner of arrangements of these base 51 and draining metal fitting 52 is the same as the conventional board siding.

Then, a plurality of main metal fittings 20 are fixed onto a post 1 (or a stud 2) in such a manner that the third upright portions 26 are respectively positioned at the center of the post 1 (or the stud 2) and are aligned along the longitudinal direction of the post 1, the main metal fittings 20 being spaced apart from each other by a predetermined distance. The fastening of the main metal fittings 20 is performed by making use of the through-holes 28 formed in the substrate 21.

Then the siding board 10 is vertically placed between the post 1 and the stud 2 (or between the stud 2 and the neighboring stud 2) and placed on the main metal fittings 20 with one of the vertical sides (the rabbeted edge portion 10*a*) of each siding board 10 being contacted with the third upright portion 26 of the main metal fitting 20 that has been fixed to the post 1 (or the stud 2). In this case, the siding board 10 is attached to the main metal fitting 20 in such a manner that the back surface thereof is placed on the vertical plane 22*a* of the first upright portion 22 as well as on the vertical plane 23*a* of the second upright portion 23, and that the distal edge portion of the rabbeted edge portion 10*a* is introduced below the locking strip 26*b* formed on the upper edge portion of the third upright portion 26 and extending sideward therefrom. As a result, one of the vertical sides 10*a* of the siding board 10 can be firmly retained by the locking strip 26*b* with the front surface of the siding board 10 being precisely directed forward.

Thereafter, a required number of main metal fittings 20 are fixed, while pushing the siding board 10 toward the main metal fitting 20, to the stud 2 (or a neighboring stud 2) in such a manner that the rabbeted edge portion 10*a* formed on the other vertical side of the siding board 10 is introduced below the other locking strips 26*a* and 26*c* formed on the upper edge portion of the third upright portion 26 and extending therefrom in the opposite direction to that of the locking strip 26*b*. As a result, the other vertical side 10*a*' of the siding board 10 can be also firmly retained by the locking strips 26*a* and 26*c* with the front surface of the siding board 10 being precisely directed forward, thereby finishing the fastening work of the siding board 10.

By repeating the same procedures as mentioned above, it is possible to construct a vertically sided structure of building frame using the siding boards where the both vertical sides of the siding board 10 are fastened by means of the main metal fittings 20 which have been attached in advance to the posts erected neighboring to each other. By the way, FIG. 2(*b*) shows a partially sectioned view of the fastened structure of two pieces of the siding boards 10 by making use of one main metal fitting 20. The aforementioned board siding can be employed in the process where the draining metal fitting 52 is secured along the base 51 and then a lower end of the siding board 10 is, as a single whole body, placed on the draining metal fitting 52 as shown in FIG. 2(*a*).

According to this vertical board siding, the fastening of the siding board 10 to a building frame can be easily performed by simply attaching a plurality of the main metal fittings 20 to both of the post and the neighboring stud or both of the neighboring studs, the plurality of the main metal fittings 20 being positioned so as to be spaced apart from each other along the longitudinal direction of each post. Namely, it is no more required to attach a large number of the horizontal furring strips across the posts as required in the conventional vertical board siding, and the nailing work can be also omitted. As a result, the board siding can be greatly simplified, and the remedy for the head portion of the nail is no more required, thus enhancing the aesthetic feeling of the resultant structure. Moreover, since the siding board is fastened in such a way that the vertical sides of siding board are clamped at a plurality of locations, the wind pressure resistive strength can be prominently enhanced as compared with the case where the siding board is fastened by means of nailing work.

Additionally, since the ventilation passage can be secured by the height of the first and second upright portions 22 and 23 formed on the main metal fitting 20, the work for additionally providing the ventilation passage can be dispensed with. Further, since these upright portions 22 and 23 are provided simply for the purpose of securing the ventilation passage, the height of these upright portions is simply required to be the minimum required. As a result, it is now possible to decrease the interval between the back surface of the siding board 10 and the building frame as compared with the conventional board siding using horizontal furring strips 5 where the ventilation passage is secured by providing a space "S" between the neighboring horizontal furring strips 5.

Next, a specific manner of employing a fastening member "A" for vertical board siding, where the fastening member "A" is constituted by the main metal fitting 20 and the auxiliary metal fitting 30 mounted on the main metal fitting 20, will be explained.

Figure 3:
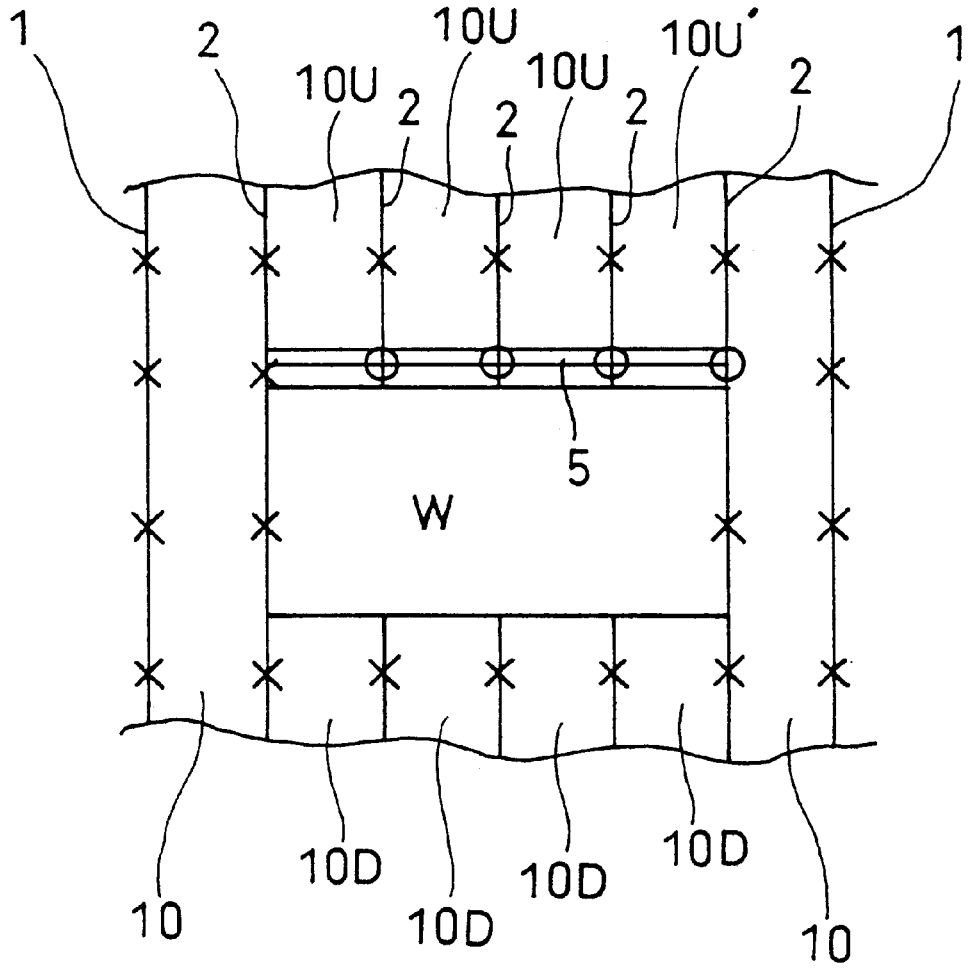
FIG. 3 is a front view schematically illustrating a fastened state of siding boards in the vicinity of an opening portion.

As shown in FIG. 3, in the vicinity of an opening portion "W" such as a window, an ordinary siding board 10 can be fastened on both sides of the opening portion "W" by means of the main metal fitting 20 (indicated by a mark X) which has been attached in advance to the post 1 or the stud 2. However, the upper side and lower side of the opening portion "W" are required to be treated by making use of special siding boards 10U and 10D which have been formed by cutting the siding board 10 to a predetermined length. In this case, the fastening of the siding board 10D at the lower side of the opening portion "W" may be performed in the same manner as the fastening of the ordinary siding board 10. In the case of fastening the siding board 10U at the upper side of the opening portion "W" however, since any member for retaining the lower end portion of the cut siding board 10U is not existed at this region as mentioned above, the fastening of the siding board 10U is not easy.

Therefore, a fastening member "A" for vertical board siding, wherein the auxiliary metal fitting 30 is mounted on the main metal fitting 20 (see FIG. 4), is directly attached to the locations which are marked by a circle O in FIG. 3, i.e. to a portion of the post 1 (or the stud 2) which is located close to the upper side of the opening portion"W". Alternatively, the fastening member "A" may be attached to the post 1 (or the stud 2) by nailing the fastening member "A" to the horizontal furring strip 5 that has been fixed in advance to the upper portion of the opening portion "W". By the way, with regard to the region which is located higher than this location close to the upper side of the opening portion "W", the fastening of the siding board 10U can be performed in the same manner by making use of the main metal fitting 2 as in the case of fastening the ordinary siding board 10.

Figure 4:
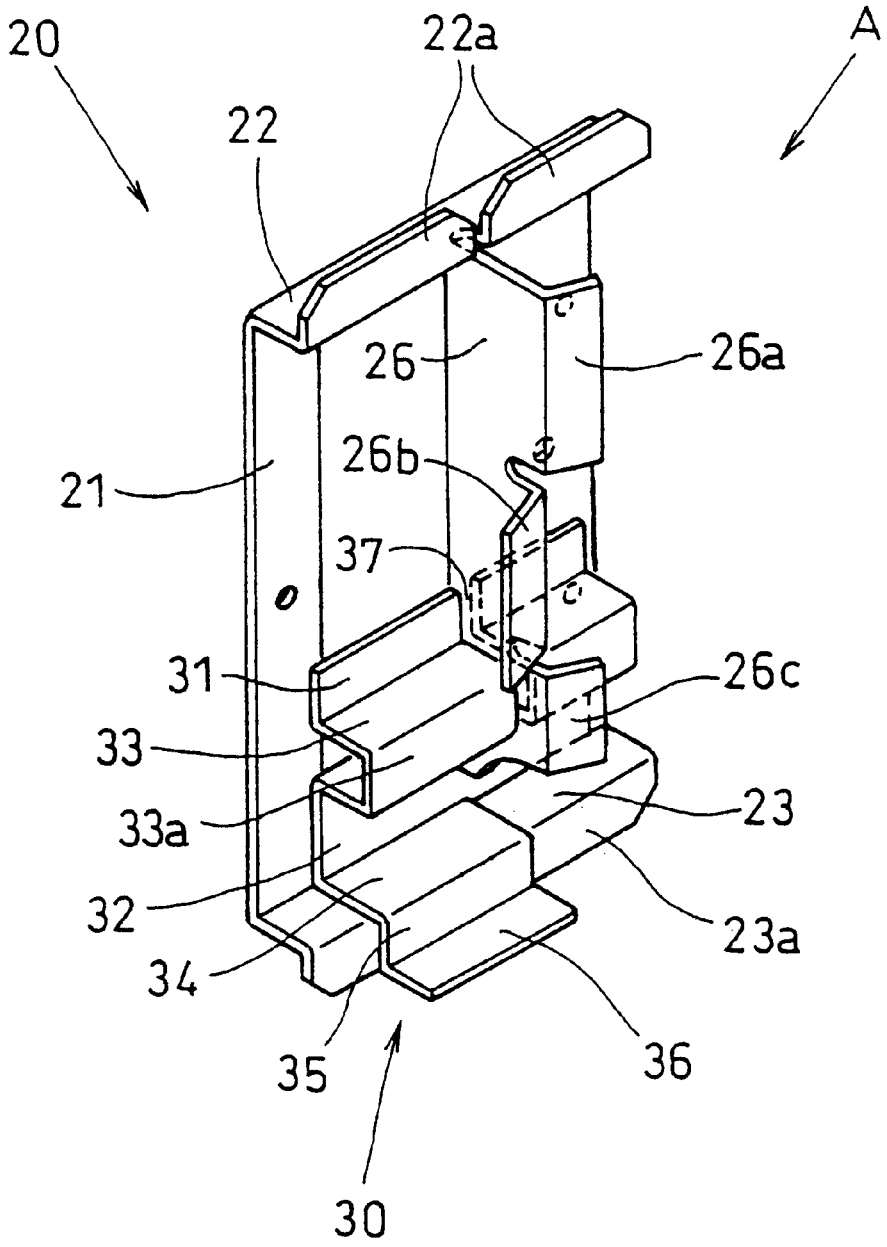
FIG. 4 is a perspective view illustrating a state wherein an auxiliary metal fitting is mounted on a main metal fitting.
Figure 5:
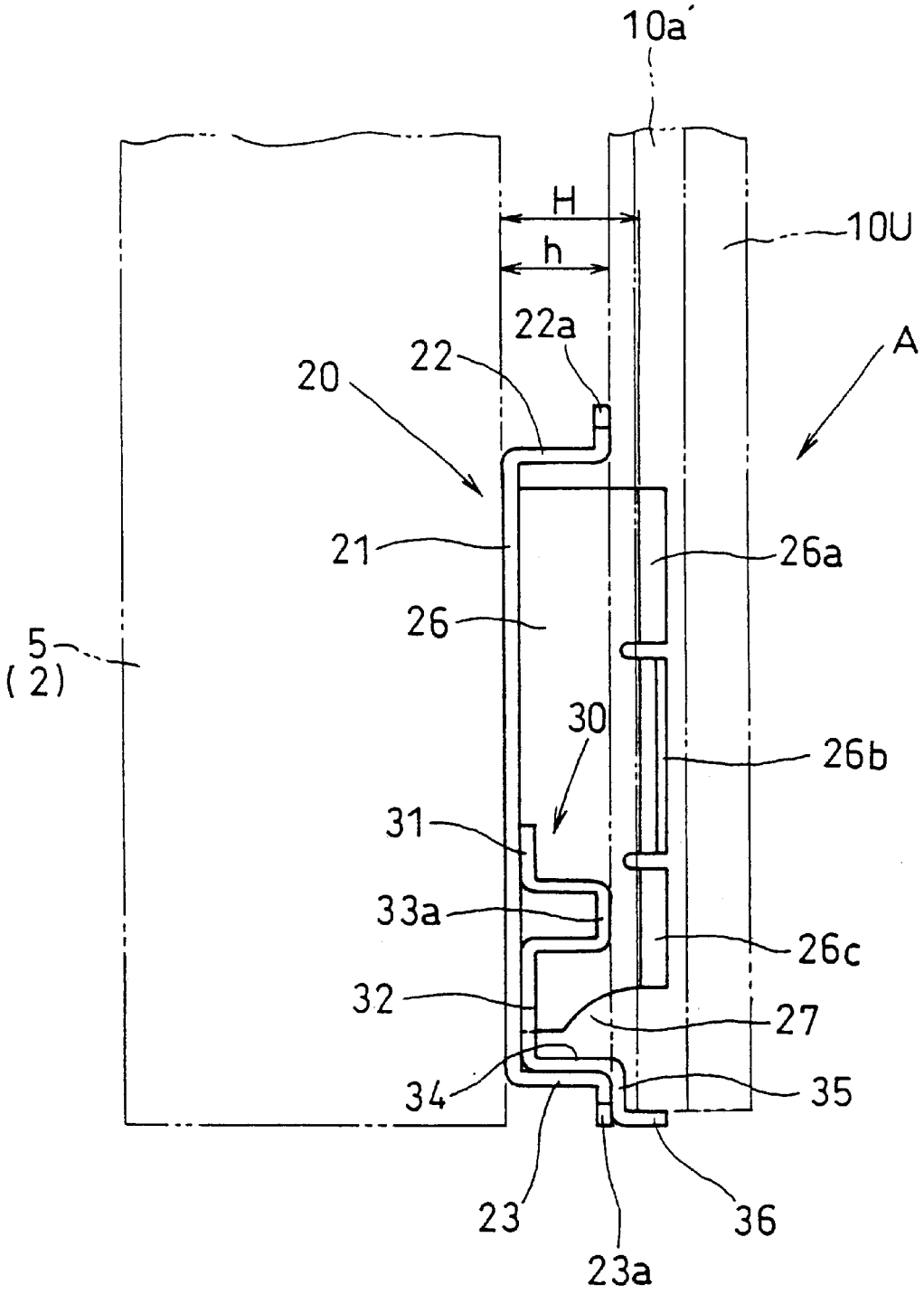
FIG. 5 is a side view illustrating a state wherein a cut siding board is fastened by making use of a fastening member shown in FIGS. 1*a* and 1*b;*
Figure 6:
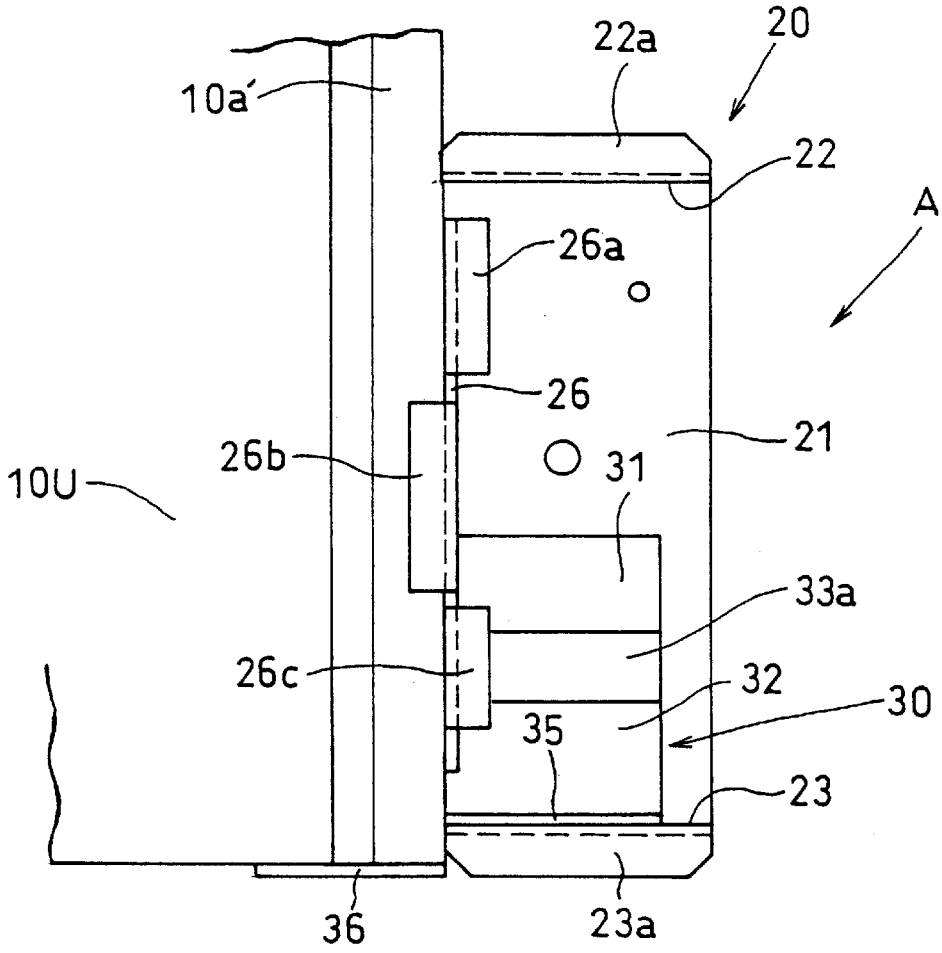
FIG. 6 is a front view illustrating a state wherein a cut siding board is fastened by making use of a fastening member shown in FIGS. 1*a* and 1*b;*

FIG. 4 shows a perspective view illustrating a state wherein the auxiliary metal fitting 30 is mounted on the main metal fitting 20, while FIG. 5 shows a side view of the state shown in FIG. 4. As shown in these FIGS., the auxiliary metal fitting 30 will be mounted on the main metal fitting 20 by introducing the auxiliary metal fitting 30 from the second upright portion 23 side of the main metal fitting 20 while inclining the auxiliary metal fitting 30 upward, thereby enabling the third upright portion 26 of the main metal fitting 20 to be inserted into the slit 37 of the auxiliary metal fitting 30, thus assembling the main metal fitting 20 and the auxiliary metal fitting 30. In this case, the cutout portion 27 formed at the lower edge portion of the third upright portion 26 enables to facilitate the insertion of the auxiliary metal fitting 30 into the main metal fitting 20.

In this assembled state, the first vertical plane 31 and second vertical plane 32 of the auxiliary metal fitting 30 are contacted with the substrate 21 of the main metal fitting 20, the first horizontal portion 34 is superimposed on the second upright portion 23 of the main metal fitting 20, and the second horizontal portion 36 is extended forward from the lower edge portion of the vertical plane 23*a* of the second upright portion 23 of main metal fitting 20.

As shown in FIG. 5, this assembled fastening member "A" is fixed to a lower end portion of the stud 2 which is located close to the upper side of the opening portion "W" and where the lower edge portion of the cut siding board 10U is to be positioned. Alternatively, the fastening member "A" may be attached to the stud 2 by nailing the fastening member "A" to the horizontal furring strip 5 that has been fixed in advance to the portion close to the upper side of the opening portion "W". Then, the siding board 10U to be fastened is attached to the fastening member "A" thereby placing the lower edge portion of the siding board 10U on the second horizontal portion 36 of the auxiliary metal fitting 30, thus making it possible to stabilize the posture of the siding board 10U.

As a result, the work for attaching the main metal fittings 20 to the region higher than this location can be extremely facilitated, and at the same time, the fastening of the cut siding board 10U can be stabilized.

According to the auxiliary metal fitting 30 of this embodiment shown in FIG. 4, the second horizontal portion 36 thereof is attached so as to be positioned on only one side of the third upright portion 26 of the main metal fitting 20. Therefore, even if the aforementioned fastening member "A" is employed for the fastening of the cut siding board 10U' which is to be positioned on the rightmost side as shown in FIG. 3, it does not interfere with the fastening of the ordinary siding board 10 to be positioned on the right side next to the cut siding board 10U'. Furthermore, even if the cut siding board 10U differs more or less in length from that of the neighboring cut siding board 10U, these siding boards do not interfere with each other, so that the fastening of these siding boards can be performed perfectly. Additionally, since the cut siding board 10U is designed to be fastened under the condition where only one half portion of the lower end thereof is retained by the second horizontal portion 36, the resultant fastening force is directed in a slantwise direction, so that a more stabilized clamping force can be achieved.

Figure 8A:
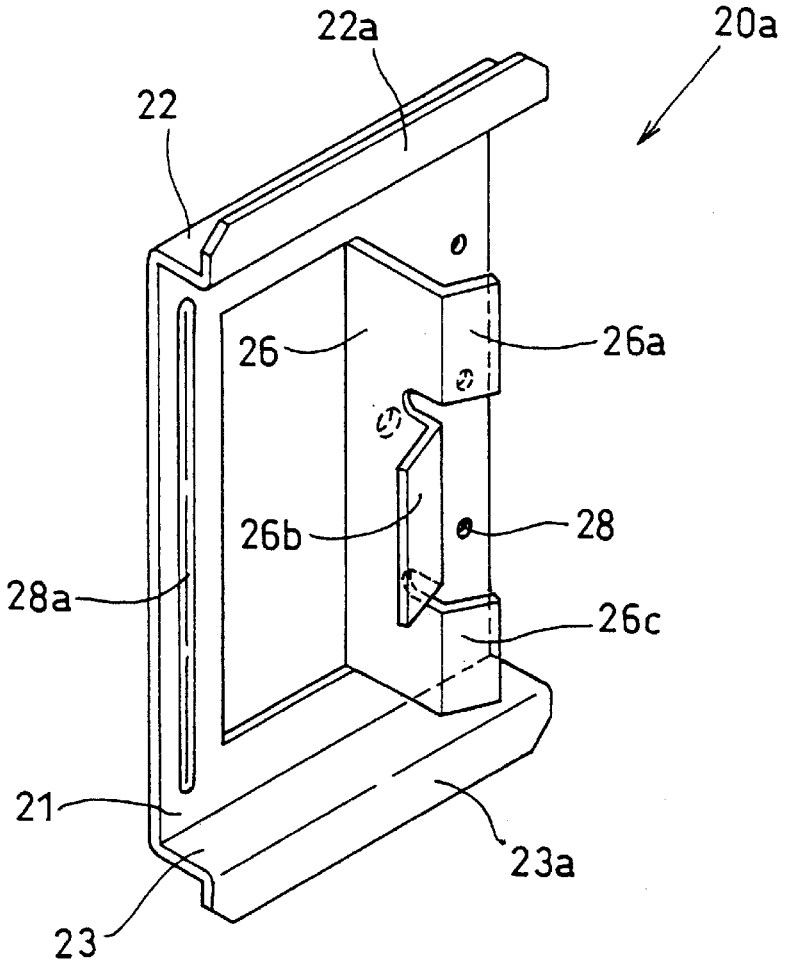
FIGS. 8*a* and 8*b* is a perspective view of a fastening member (a main metal fitting and an auxiliary metal fitting) for vertical board siding representing another embodiment of this invention.
Figure 8B:
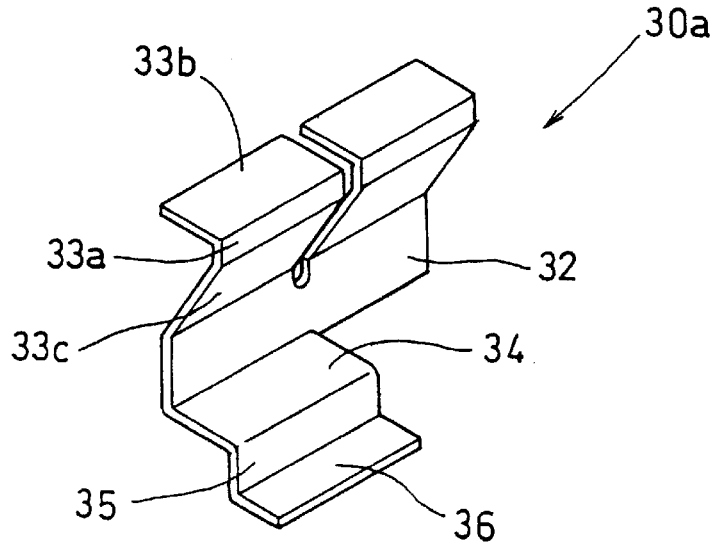

FIGS. 8*a* and 8*b* shows another embodiment of the fastening member, wherein the structure of main metal fitting 20*a* differs from the aforementioned main metal fitting 20 in the respects that the third upright portion 26 is not provided at the lower end portion thereof with the cutout portion, and that the through-hole 28*a* formed in the substrate 21 is constituted by a slit. On the other hand, the auxiliary metal fitting 30*a* differs from the aforementioned auxiliary metal fitting 30 in the respects that the first vertical plane 31 is omitted, and that the protruded portion 33 is constituted by an erected plane 33*b*, a flat upper surface 33*a* and an inclined surface 33*c* formed contiguous with the flat upper surface 33*a*.

It is possible with this auxiliary metal fitting 30*a* constructed in this manner to facilitate the mounting thereof on the main metal fitting 20*a* even if the cutout portion is not formed at the lower end portion of the third upright portion 26. Further, since the substrate 21 is provided with the slit 28*a*, the attachment of the main metal fitting 20*a* to the post 1 or the stud 2 can be facilitated.

Figure 9:
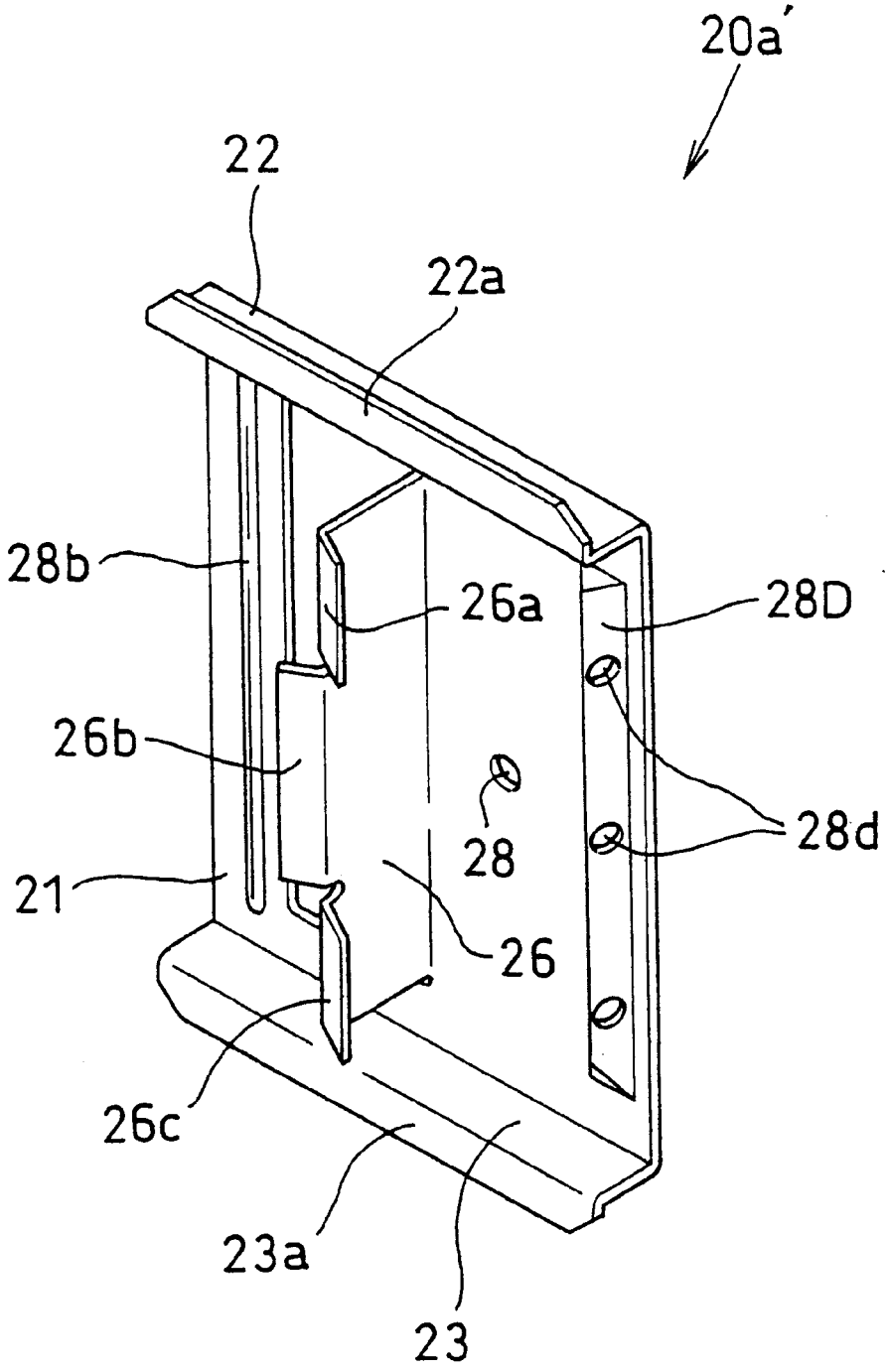
FIG. 9 is a perspective view illustrating another example of the main metal fitting constituting the fastening member for vertical board siding according to this invention.

FIG. 9 shows still another embodiment of the fastening member, wherein the structure of main metal fitting 20*a*' differs from the main metal fitting 20*a* shown in FIG. 8 in the respects that the slit 28*a* is replaced by a first rib 28*b*, and that a second rib 28D having a height higher than that of the first rib 28*b* is formed on the side opposite to where the first rib 28*b* is formed, and through-holes 28*d* are formed in a slanted surface constituting the outward surface of the second rib 28D.

According to this main metal fitting 20*a*', since the first rib 28*b* and the second rib 28D are formed on the substrate 21, the bending strength of the substrate 21 can be improved. Further, since the through-holes 28*d* are formed in the second rib 28D, the attachment of the main metal fitting 20*a*' to the building frame by means of nailing for example by making use of these through-holes 28*d* can be facilitated. The auxiliary metal fitting that can be employed together with this main metal fitting 20*a*' may be the same as the auxiliary metal fittings 30 and 30A shown in FIGS. 1*a*–1*b* and 8*a*–8*b*.

Figure 10:
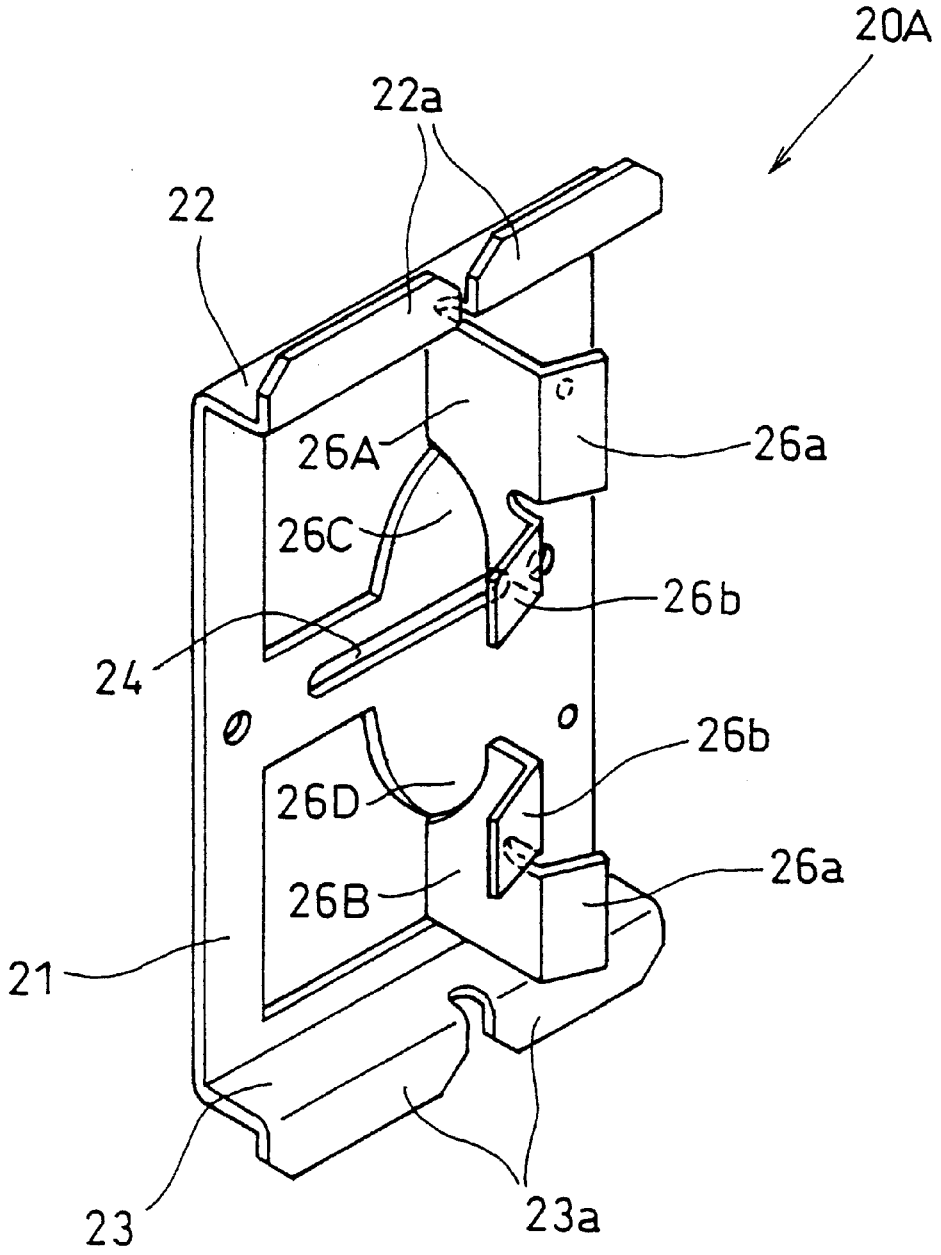
FIG. 10 is a perspective view illustrating further example of the main metal fitting constituting the fastening member for vertical board siding according to this invention.
Figure 11:
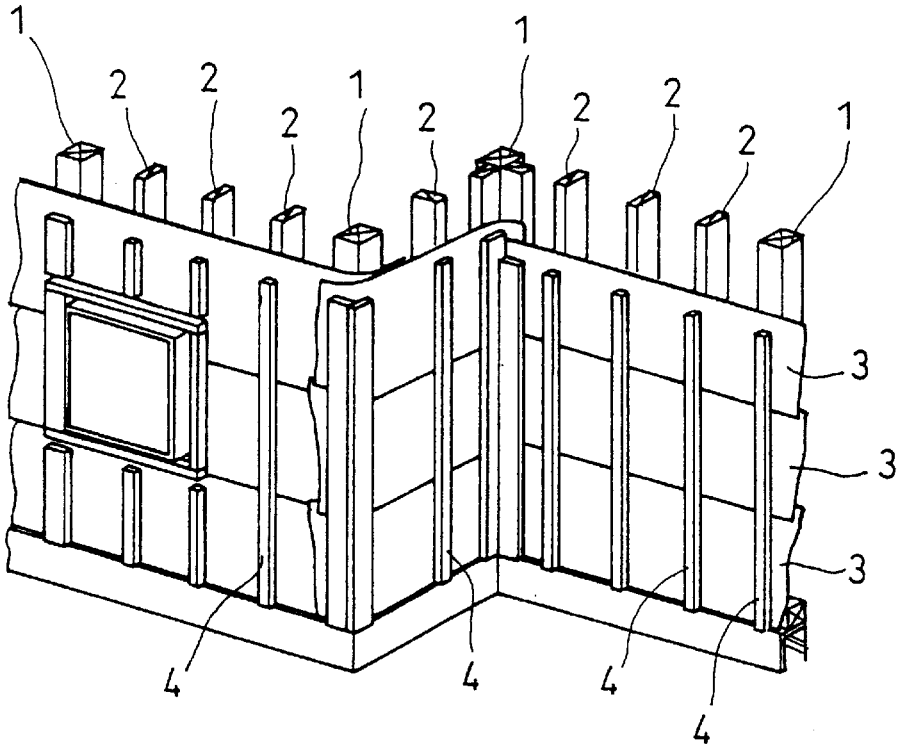
FIG. 11 (PRIOR ART)
FIG. 11 is a perspective view illustrating a conventional backing framework for a horizontal board siding.
Figure 12:
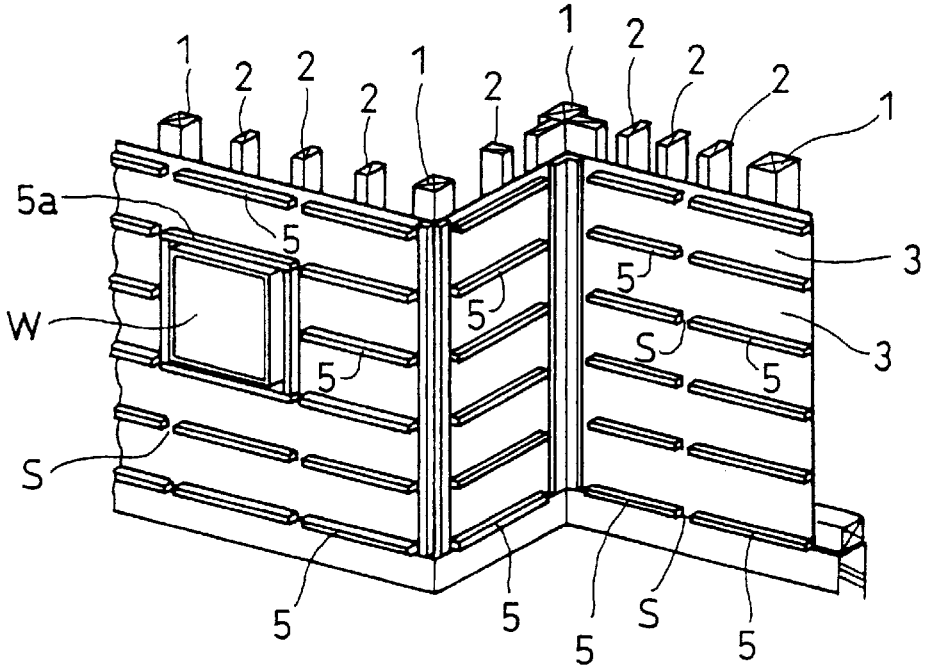
FIG. 12 (PRIOR ART)
FIG. 12 is a perspective view illustrating a conventional backing framework for a vertical board siding.
Figure 13:
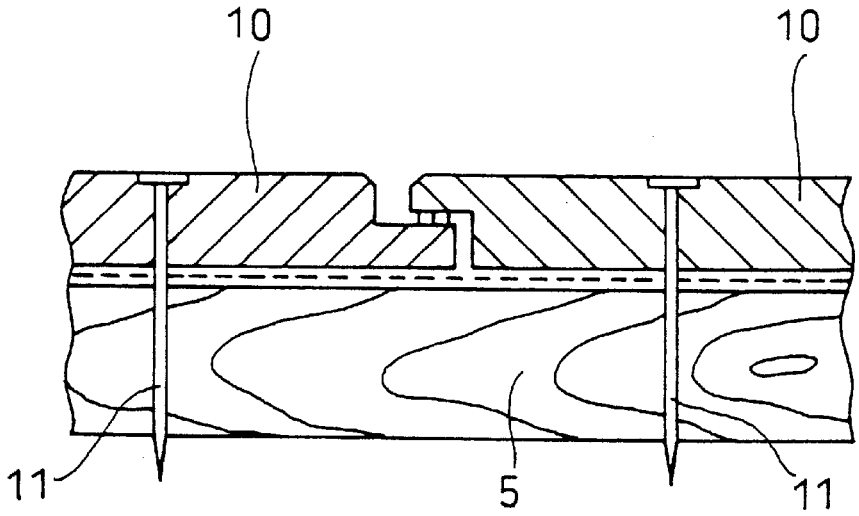
FIG. 13 (PRIOR ART)
FIG. 13 is a cross-sectional view illustrating a fastened state of siding boards in the conventional vertical board siding.
Figure 14:
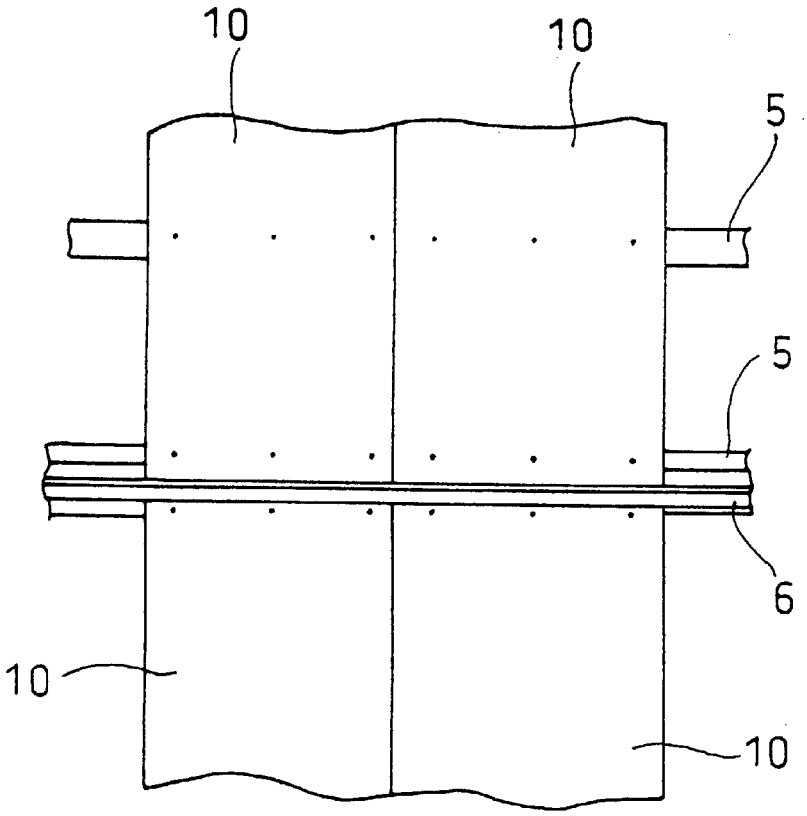
FIG. 14 (PRIOR ART)
FIG. 14 is a front view illustrating a fastened state of the siding boards in the conventional vertical board siding.
Figure 15:
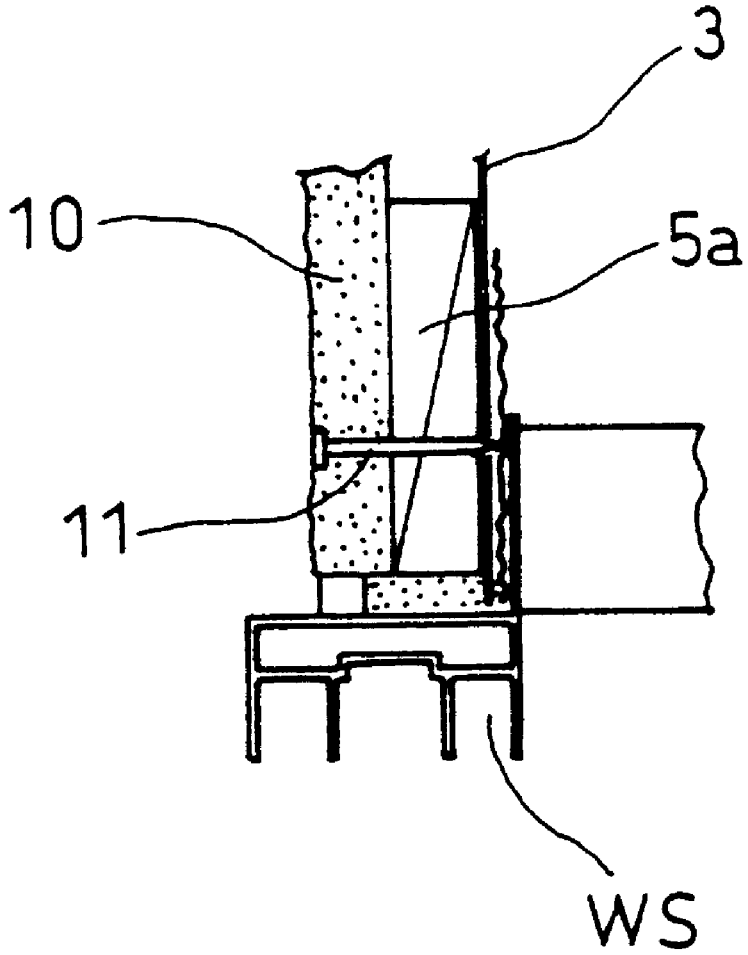
FIG. 15 (PRIOR ART)
FIG. 15 is a cross-sectional view illustrating the conventional board siding at the upper side portion of an opening portion such as a window.

FIG. 10 shows another embodiment of the main metal fitting 20. The structure of this main metal fitting 20A differs from the main metal fitting 20 shown in FIG. 1 in the respects that the slit 24 extending transversely (horizontally) is formed at approximately the middle portion (as measured in vertical direction) of the substrate 21; that the third upright portion 26 is replaced by an upper third upright portion 26A and by a lower third upright portion 26B which are formed between the aforementioned slit 24 and the first upright portion 22, and between the aforementioned slit 24 and the second upright portion 23, respectively; and that cutout portions 26C and 26D are formed at the inner fringe portions (both facing the slit 24) of the upper and lower third upright portions 26A and 26B, respectively.

According to this main metal fitting 20A, it is possible, by provisionally inserting a locking screw (not shown) through the slit 24 into the post 1 or the stud 2, to temporally attach the main metal fitting 20A to the post 1 or the stud 2 while enabling it to be moved laterally. Therefore, under the condition where the main metal fitting 20A is provisionally attached, the siding board 10 may be vertically placed between the posts or studs, and then, the main metal fitting 20A may be laterally moved so as to allow the rabbeted edge portion 10*a* (10*a*') constituting the vertical sides the siding board 10 to be inserted below the locking strips 26*b* formed on the upper edges of the upper and lower third upright portions 26A and 26B. Under this condition, the locking screw is further screwed into the post or stud thereby to firmly fix the main metal fitting 20A to the post or stud, thus enabling the siding board 10 to be firmly fastened. As explained above, the board siding can be more easily performed, and at the same time, even if there is a slight error in the framework of the posts, such an error can be suitably overcome. When this main metal fitting 20A is combined with the auxiliary metal fitting 30 or 30A shown in FIGS. 1 and 8, the fastening of the cut siding board 10U at the region indicated by the mark "O" in FIG. 3 can be facilitated.

According to the forgoing explanation, the second horizontal portion 36 of the auxiliary metal fitting is attached so as to be positioned on only one side of the third upright portion 26 of the main metal fitting. However, since this configuration is adopted as preferable in viewpoint of easiness in the attachment work thereof, it will be understood that this second horizontal portion 36 may be formed so as to be positioned along the full width of the third upright portion 26 of the main metal fitting. Further, although it is explained in the foregoing explanation that the third upright portion 26 is formed by cutting and bending a portion of the substrate 21, the third upright portion 26 may be formed separately from the substrate 21 and then fixed to the substrate 21 by means of welding.

According to this invention, it is possible to firmly fasten the siding boards in the vertical state to the building frame by simply attaching a plurality of fastening members to each of the neighboring posts along the longitudinal direction of each post, thereby making it possible to greatly simplify the board siding and at the same time, to enhance the aesthetic feeling of the resultant structure. Moreover, since the siding board is fastened in such a way that the vertical sides of siding board are clamped at a plurality of locations, the wind pressure resistive strength can be prominently enhanced. Further, since the siding board is fastened by making use of this fastening member, a ventilation passage can be easily secured.

Furthermore, even if the siding board is to be fastened to the stud after cutting the siding board to a predetermined length, it is possible to easily and reliably fasten the lower end portion of the siding board without necessitating the nailing of the siding board while holding the siding board by one's hand as required in the conventional board siding.

What is claimed is:

1. A fastened structure of a lower end portion of a vertical siding board, comprising a plurality of posts located adjacent to each other;

a main metal fitting comprising a flat substrate constituting a mounting surface to a building frame, a first upright portion and a second upright portion formed at upper and lower end portions of said flat substrate, respectively, and extending in a lateral direction of said flat substrate, a third upright portion formed along a longitudinal direction of said flat substrate, and an engaging portion formed at a distal end of said third upright portion, said main metal fitting is fixed to a portion of one of the posts where the lower end portion of the siding board is to be fastened; and an auxiliary metal fitting detachably engaged with said main metal fitting so that a first horizontal portion of said auxiliary metal fitting rests on said second upright portion of said main metal fitting;

wherein said siding board is fastened to the main metal fitting while rendering the lower end portion of said siding board to be received by a second horizontal portion of said auxiliary metal fitting.

2. A fastening member for vertical siding boards, comprising:

a main metal fitting comprising a flat substrate constituting a mounting surface to a building frame, a first upright portion and a second upright portion formed at upper and lower end portions of said flat substrate, respectively, and extending in a lateral direction of said flat substrate, a third upright portion formed along a longitudinal direction of said flat substrate, and an engaging portion formed at a distal end of said third upright portion; and an auxiliary metal fitting which is adapted to be detachably engaged with said main metal fitting and comprises a first horizontal portion which is adapted to be mounted on said second upright portion of said main metal fitting, and a second horizontal portion which is adapted to support a lower end of a siding board to be fastened.

3. The fastening member according to claim 2, wherein said second horizontal portion is configured so as to be placed on only one side of said third upright portion of said main metal fitting as said auxiliary metal fitting is mounted on said main metal fitting.

4. The fastening member according to claim 2, wherein said engaging portion includes first and second locking strips which are bent in opposite lateral directions to each other and which are adapted to grip a side edge of one siding board.

5. The fastening member according to claim 2, further including in said third upright portion a cutout facing said second upright portion to facilitate mounting of said auxiliary metal fitting on said main metal fitting.

6. The fastening member according to claim 2, further including in said auxiliary metal fitting a slit to receive said third upright portion when said auxiliary metal fitting is mounted on said main metal fitting.

7. The fastening member according to claim 2, wherein each of said first and second upright portions further includes at a distal end thereof a planar surface adapted to provide backing for a back surface of said siding board to be fastened.

8. The fastening member according to claim 2, wherein a ventilation passage is formed by said first and second upright portions between said flat substrate and said siding board to be fastened.

9. The fastening member according to claim 2, wherein said main metal fitting is formed from a single metal piece.

10. The fastening member according to claim 2, wherein said auxiliary metal fitting is formed from a single metal piece.

11. The fastening member according to claim 2, wherein said auxiliary metal fitting further includes a first vertical plane extending from a horizontal edge of said first horizontal portion and a U-shaped portion extending from a horizontal edge of said first vertical plane.

12. The fastening member according to claim 11, wherein said U-shaped portion includes an inclined surface extending from said horizontal edge of said first vertical plane to facilitate mounting of said auxiliary metal fitting on said main metal fitting.

13. The fastening member according to claim 11, wherein said flat substrate provides backing for said first vertical plane when said auxiliary metal fitting is mounted on said main metal fitting.

14. The fastening member according to claim 11, wherein said auxiliary metal fitting further includes a second vertical plane extending from a horizontal edge of said U-shaped portion, said flat substrate provides backing for said second vertical plane when said auxiliary metal fitting is mounted on said main metal fitting.

15. The fastening member according to claim 11, wherein said U-shaped portion includes an planar surface adapted to provide backing for a back surface of said siding board to be fastened.

16. A method of fastening a lower end portion of a siding board in installing vertical board siding by using posts located adjacent to each other, said method comprising the steps of:

attaching a main metal fitting having a flat substrate to a portion of one of the posts where the lower end portion of the siding board is to be fastened;

mounting an auxiliary metal fitting to said main metal fitting so that a first horizontal portion of said auxiliary metal fitting rests on an upright portion formed at a lower end portion of said flat substrate and extending in a lateral direction of said flat substrate; and griping a side edge of the siding board with an engaging portion located at a distal end of another upright portion formed along a longitudinal direction of said flat substrate, to thereby fasten the siding board to said main metal fitting while rendering the lower end portion of the siding board to be received by a second horizontal portion of said auxiliary metal fitting.

17. A method of fastening a lower end portion of a siding board in installing vertical board siding by using posts located adjacent to each other, said method comprising the steps of:

attaching a main metal fitting comprising a flat substrate, a first upright portion and a second upright portion formed at upper and lower end portions of said flat substrate, respectively, and extending in a lateral direction of said flat substrate, a third upright portion formed along a longitudinal direction of said flat substrate, and an engaging portion formed at a distal end of said third upright portion, to a portion of one of the posts where the lower end portion of the siding board is to be fastened;

mounting an auxiliary metal fitting which is adapted to be detachably engaged with said main metal fitting and comprises a first horizontal portion adapted to be mounted on said second upright portion of said main metal fitting, and a second horizontal portion adapted to support the lower end of the siding board, to said main metal fitting; and fastening the siding board to said main metal fitting while rendering the lower end portion of the siding board to be received by the second horizontal portion of said auxiliary metal fitting.

* * * * *